US012551746B2

(12) United States Patent
Cathcart

(10) Patent No.: US 12,551,746 B2
(45) Date of Patent: Feb. 17, 2026

(54) WEIGHT BAR HOLDING APPARATUS FOR WEIGHTLIFTING RACK

(71) Applicant: Hayln Cathcart, St. Albert (CA)

(72) Inventor: Hayln Cathcart, St. Albert (CA)

( * ) Notice: Subject to any disclaimer, the term of this patent is extended or adjusted under 35 U.S.C. 154(b) by 80 days.

(21) Appl. No.: 18/610,754

(22) Filed: Mar. 20, 2024

(65) Prior Publication Data

US 2025/0010122 A1 Jan. 9, 2025

Related U.S. Application Data

(60) Provisional application No. 63/512,105, filed on Jul. 6, 2023.

(51) Int. Cl.
*A63B 21/078* (2006.01)

(52) U.S. Cl.
CPC ..... *A63B 21/078* (2013.01); *A63B 2225/093* (2013.01)

(58) Field of Classification Search
CPC ..... A63B 21/0615; A63B 21/4035; A63B 21/4039; A63B 21/0724; A63B 21/0728; A63B 17/04; A63B 2208/0257; A63B 2208/0285
See application file for complete search history.

(56) References Cited

U.S. PATENT DOCUMENTS

| | | | | |
|---|---|---|---|---|
| 5,954,619 | A * | 9/1999 | Petrone | A63B 71/0036 482/106 |
| 11,406,862 | B2 * | 8/2022 | Downing | A63B 21/078 |
| 12,246,210 | B2 * | 3/2025 | Tighe | A63B 21/078 |
| 2009/0137368 | A1 * | 5/2009 | Parrilla | A63B 21/078 482/104 |
| 2022/0323816 | A1 * | 10/2022 | Sorin | A63B 21/0615 |

* cited by examiner

*Primary Examiner* — Andrew M Kobylarz
(74) *Attorney, Agent, or Firm* — Ryan W. Dupuis; Kyle R. Satterthwaite; Ade & Company Inc.

(57) ABSTRACT

A weight bar holding apparatus supports a weight bar on an upright post of exercise equipment. The apparatus has a mounting bracket securable to the post with two pins through cooperating apertures of multiple mounting locations at spaced positions on the bracket to secure the bracket at an adjustable spacing to the post. Two hooks protrude from the bracket on the post at a lateral spacing between the hooks that is more than twice a corresponding width of the upright post to provide stable support to a weight bar on a singular post of a weightlifting rack. A stop may be provided above the upper surface of each hook to prevent the weight bar from lifting off the hook when weighted unevenly during loading and unloading of weights onto the bar.

20 Claims, 4 Drawing Sheets

WEIGHT BAR HOLDING APPARATUS FOR WEIGHTLIFTING RACK

This application claims the benefit under 35 U.S.C. 119(e) of U.S. provisional application Ser. No. 63/512,105, filed Jul. 6, 2023.

FIELD OF THE INVENTION

The present invention relates to an apparatus for attachment onto the upright post of exercise equipment, for example a rack used in weightlifting having upright posts with transverse apertures formed therein, and more particularly the present invention relates to an apparatus arranged to support a weightlifting bar thereon while being attached to a weightlifting rack.

BACKGROUND

Weightlifting racks are commonly used to support various types of weight bars thereon to assist a user performing various weightlifting exercises. One common type of rack typically comprises a set of corners posts that are joined by cross bars to form a rigid frame. The rack is typically provided with various types of hooks that can be readily attached to the posts of the rack using mounting apertures in the posts to secure the hooks to the posts. The hooks are commonly used in pairs mounted onto a pair of spaced apart posts of the rack respectively so that a weight bar can span between the two hooks on the two respective posts to allow the user to position themselves between the two posts under the weight bar for performing a weightlifting exercise in a safe and controlled manner. In some instances, it is desirable to perform weightlifting exercises using shorter weight bars that may not have sufficient length to span between hooks mounted no two spaced apart posts of the rack; however, known hooks supported on a singular post of a weightlifting rack are not intended to support intermediate sized weight bars thereon in a stable manner.

SUMMARY OF THE INVENTION

According to one aspect of the invention there is provided a weight bar holding apparatus for supporting a weight bar on an upright post of exercise equipment, the upright post having transverse apertures formed therein at different respective elevations along the upright post, the apparatus comprising:

- a mounting bracket having first and second mounting surfaces that are parallel and spaced apart from one another so as to be arranged for abutment against opposing sides of the upright post;
- at least one mounting pin arranged to be mounted on the mounting bracket to extend through a respective one of the transverse apertures in the upright post to support mounting bracket at the respective elevation along the upright post in a mounted position of the apparatus; and
- two hooks protruding in a longitudinal direction from the mounting bracket, each hook including an upper hook surface arranged to receive a portion of the weight bar thereon in which the upper hook surfaces lie in a common horizontal plane in the mounted position of the apparatus;
- wherein the two hooks are spaced apart from one another transversely to the longitudinal direction by a prescribed space that is more than twice a corresponding width of the upright post.

The use of two hooks that are spaced apart by a considerable distance while remaining supported on a singular post of a weightlifting rack allows intermediate sized weight bars to be supported in a stable manner on a weightlifting rack in a manner previously unseen in the prior art.

A cross member is preferably connected between the two hooks at a location spaced longitudinally from the mounting bracket and spaced below the upper hook surfaces.

Preferably the hooks each include a raised protrusion extending above the upper hook surface at a location spaced from the mounting bracket. The cross member is preferably nearer to the raised protrusion than the mounting bracket.

Each hook may further comprise a guide surface extending vertically above the upper hook surface adjacent to the mounting bracket. The guide surface is preferably greater in height than a length of the upper hook surface.

Each hook may further include a stop member spaced above the upper hook surface so as to be arranged to receive the weight bar on the hook surface beneath the stop member. In this instance, the upper hook surface preferably protrudes longitudinally from the mounting bracket farther than the stop member.

Each hook may also further comprise a recessed surface formed at an inner end of the upper hook surface nearest to the mounting bracket, in which the recessed surface is recessed in elevation below the upper hook surface, and the recessed surface is aligned in the longitudinal direction with the stop member above the recessed surface. The stop member may have a bottom surface which is sloped downwardly and away from the mounting bracket towards an outer end of the stop member farthest from the mounting bracket.

Each hook may further comprise a guide surface extending vertically upward from the stop member above the upper hook surface in which the upper hook surface protrudes longitudinally outward beyond the guide surface.

When the at least one mounting pin includes an upper mounting pin and a lower mounting pin, the mounting bracket preferably includes a plurality of designated mounting locations formed thereon at spaced apart positions in the longitudinal direction corresponding to respective selected distances of the hooks from the upright post, in which each designated mounting location includes an upper pin aperture and a lower pin aperture arranged to receive the upper mounting pin and the lower mounting pin respectively therein when the mounting pins are received through the transverse apertures of the upright post at the respective selected distance of the hooks from the upright post.

In this instance, the mounting bracket may comprise: a first side plate locating the first mounting surface thereon, a second side plate locating the second mounting surface thereon, a first cross member joined between the first and second side plates, and a second cross member joined between the first and second side plates at a location spaced in the longitudinal direction from the first cross member, in which the pin apertures extend through the first and second side plates parallel to the first and second cross members.

The first cross member may comprises a plate joined between the first and second side plates so as to lie perpendicularly to the longitudinal direction, and the second cross member may comprise an elongated crossbar.

A handle member may be mounted on the mounting bracket so as to protrude from the mounting bracket in the longitudinal direction with the hooks, in which the handle member is spaced laterally inwardly from each of the hook and the handle member being configured to be gripped in a hand of a user. Each hook may further comprise a guide surface extending vertically upward from the stop member above the upper hook surface in which the guide surfaces are spaced longitudinally outward from the mounting bracket farther than an outermost portion of the handle member.

According to a second aspect of the present invention there is provided a weight bar holding apparatus for supporting a weight bar on an upright post of exercise equipment, the upright post having transverse apertures formed therein at different respective elevations along the upright post, the apparatus comprising:

a mounting bracket having first and second mounting surfaces that are parallel and spaced apart from one another so as to be arranged for abutment against opposing sides of the upright post;

at least one mounting pin arranged to be mounted on the mounting bracket to extend through a respective one of the transverse apertures in the upright post to support mounting bracket at the respective elevation along the upright post in a mounted position of the apparatus; and at least one hook protruding in a longitudinal direction from the mounting bracket in which the hook includes (i) an upper hook surface arranged to receive a portion of the weight bar thereon and (ii) a stop member spaced above the upper hook surface so as to be arranged to receive the weight bar on the hook surface below the stop member in which the upper hook surface protrudes longitudinally from the mounting bracket further than the stop member.

When the hooking surfaces are located at a narrow spacing relative to one another compared to the length of the weight bar, the location of the stop member above the hook prevents the weight bar from lifting off of the hook surface of the hook when the weight bar is weighted unevenly during loading and unloading of weights onto the bar.

In this instance, said at least one hook may further comprise a recessed surface formed at an inner end of the upper hook surface nearest to the mounting bracket, in which the recessed surface is recessed in elevation below the upper hook surface, and the recessed surface is aligned in the longitudinal direction with the stop member above the recessed surface. The at least one hook may be further arranged such that the stop member has a bottom surface which is sloped downwardly and away from the mounting bracket towards an outer end of the stop member farthest from the mounting bracket.

According to a further aspect of the present invention there is provided a weight bar holding apparatus for supporting a weight bar on an upright post of exercise equipment, the upright post having transverse apertures formed therein at different respective elevations along the upright post, the apparatus comprising:

a mounting bracket having first and second mounting surfaces that are parallel and spaced apart from one another so as to be arranged for abutment against opposing sides of the upright post; and at least one hook protruding in a longitudinal direction from the mounting bracket in which the hook includes an upper hook surface arranged to receive a portion of the weight bar thereon; and an upper mounting pin and a lower mounting pin arranged to be mounted on the mounting bracket to extend through a respective pair of the transverse apertures in the upright post to support mounting bracket on the upright post;

wherein the mounting bracket includes a plurality of designated mounting locations formed thereon at spaced apart positions in the longitudinal direction corresponding to respective selected distances of the at least one hook from the upright post; and wherein each designated mounting location includes an upper pin aperture and a lower pin aperture arranged to receive the upper mounting pin and the lower mounting pin respectively therein when the mounting pins are received through the transverse apertures of the upright post at the respective selected distance of the at least one hook from the upright post.

The adjustable spacing of the hooks from the upright post allows the apparatus to support a weight bar thereon in an optimal location relative to the rack depending on the type of exercise being performed. The user can thus position themselves closer or farther from the weightlifting rack as may be desired depending upon the type of exercise, while allowing the weight bar to be optimally placed relative to the user in each instance. This also allows the user to use larger diameter weight plates while avoiding clashes/interference with adjacent rack posts or cross beams.

In this instance, the mounting bracket may comprise: a first side plate locating the first mounting surface thereon, a second side plate locating the second mounting surface thereon, a first cross member joined between the first and second side plates, and a second cross member joined between the first and second side plates at a location spaced in the longitudinal direction from the first cross member, in which the pin apertures extend through the first and second side plates parallel to the first and second cross members.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
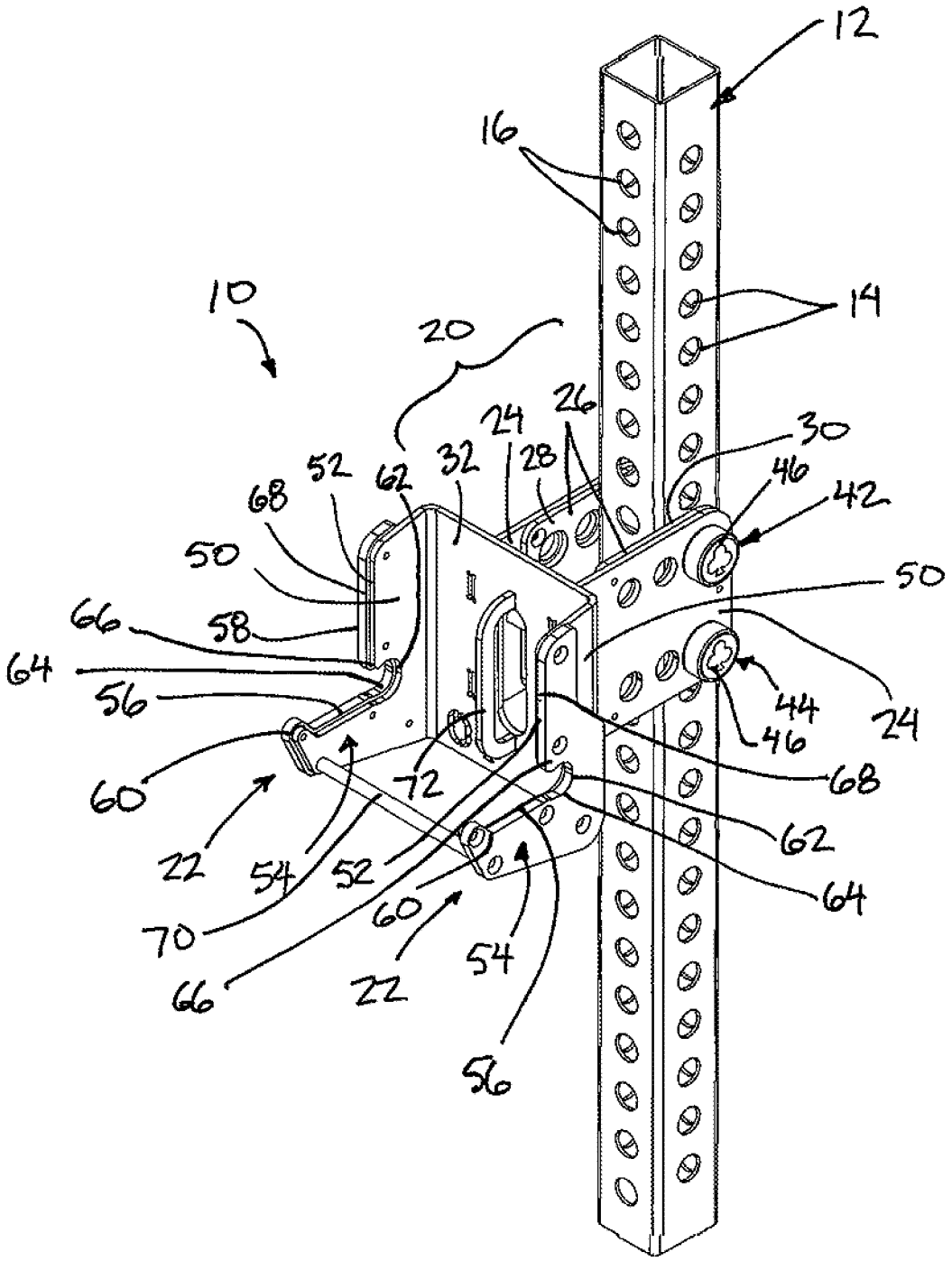
FIG. 1 is perspective view of the weight bar holding apparatus of the present invention according to a first embodiment, shown supported on the vertical post of a weight lifting rack.
Figure 2:
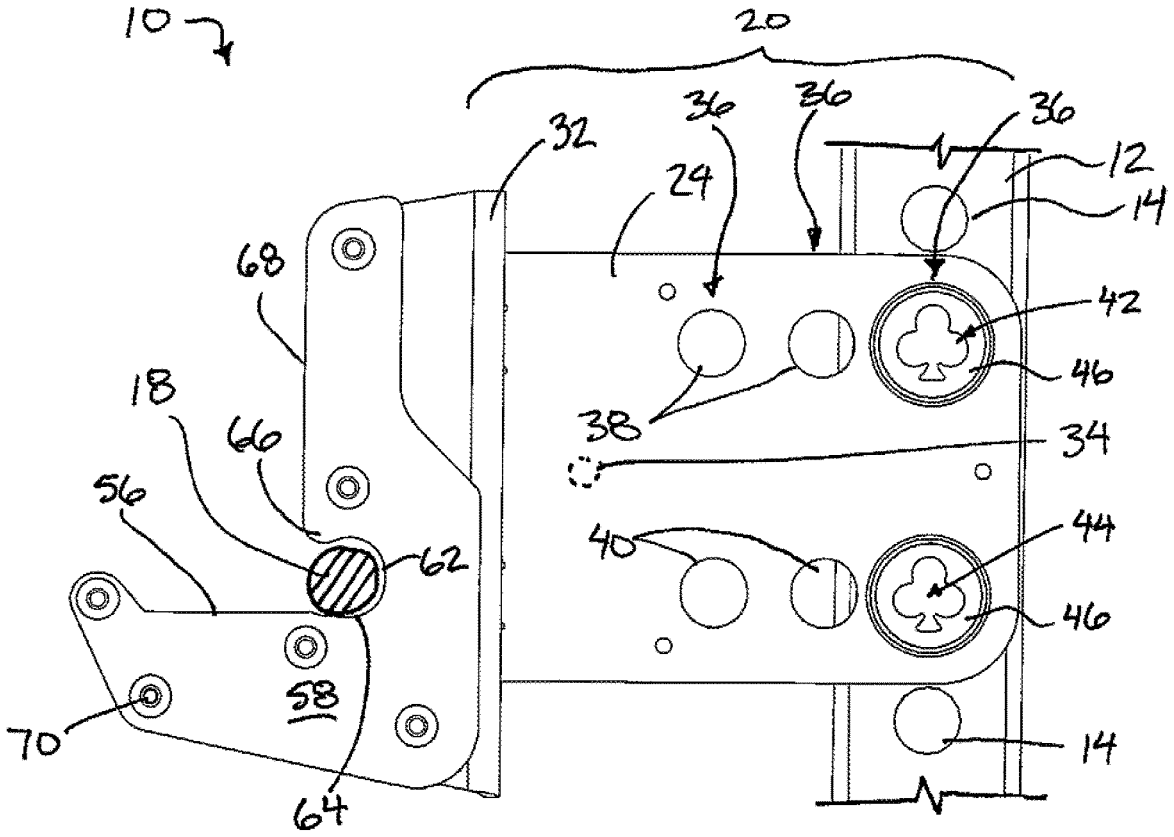
FIG. 2 is side elevational view of the apparatus according to the first embodiment of FIG. 1.
Figure 3:
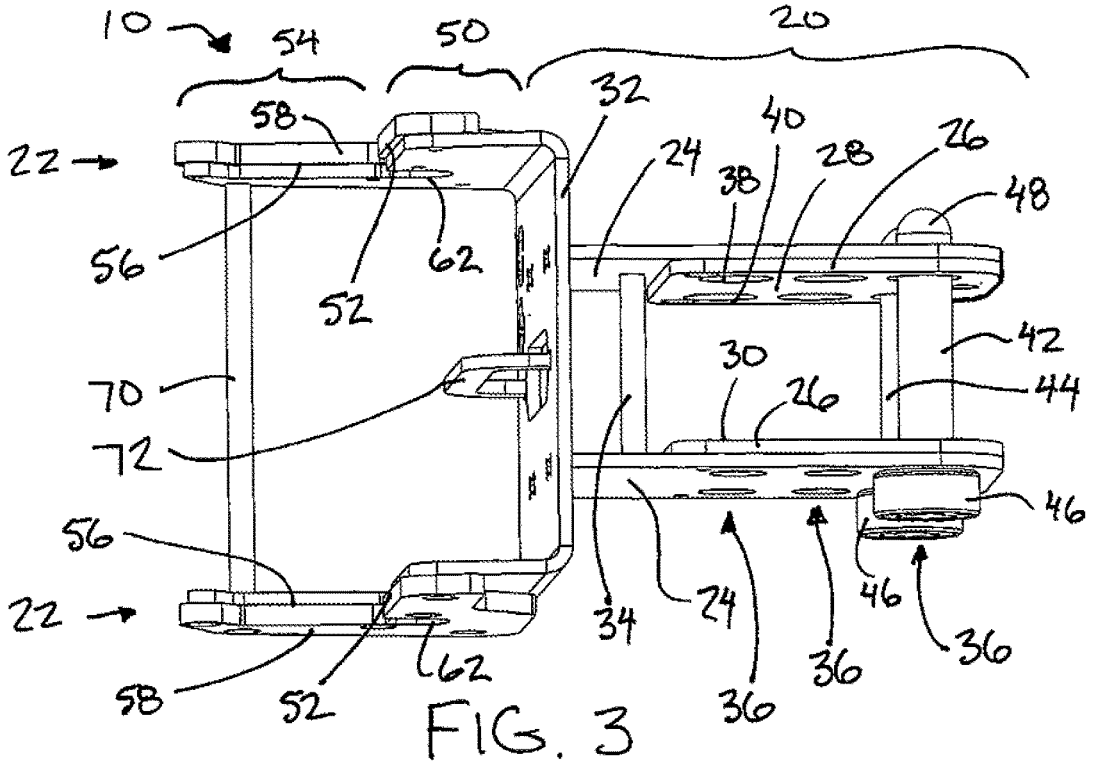
FIG. 3 is a perspective view of a top side of the apparatus according to the first embodiment of FIG. 1 shown removed from the post.
Figure 4:
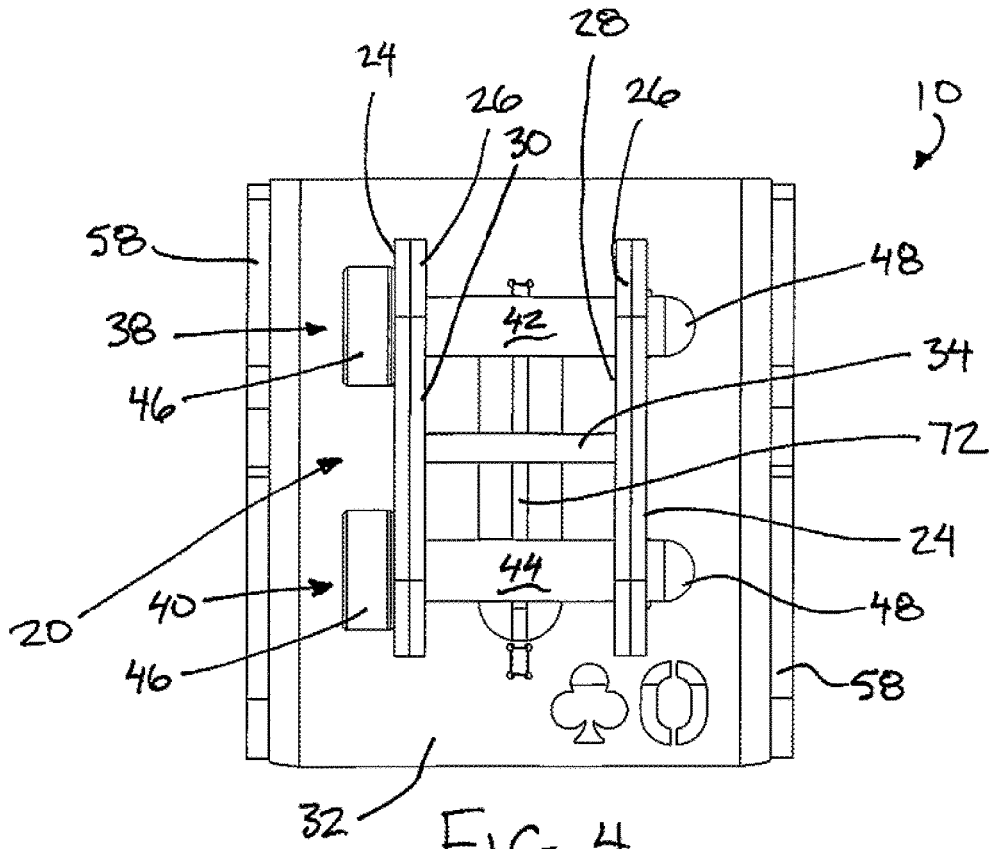
FIG. 4 is a rear elevational view of the apparatus according to the first embodiment of FIG. 1 shown removed from the post.
Figure 5:
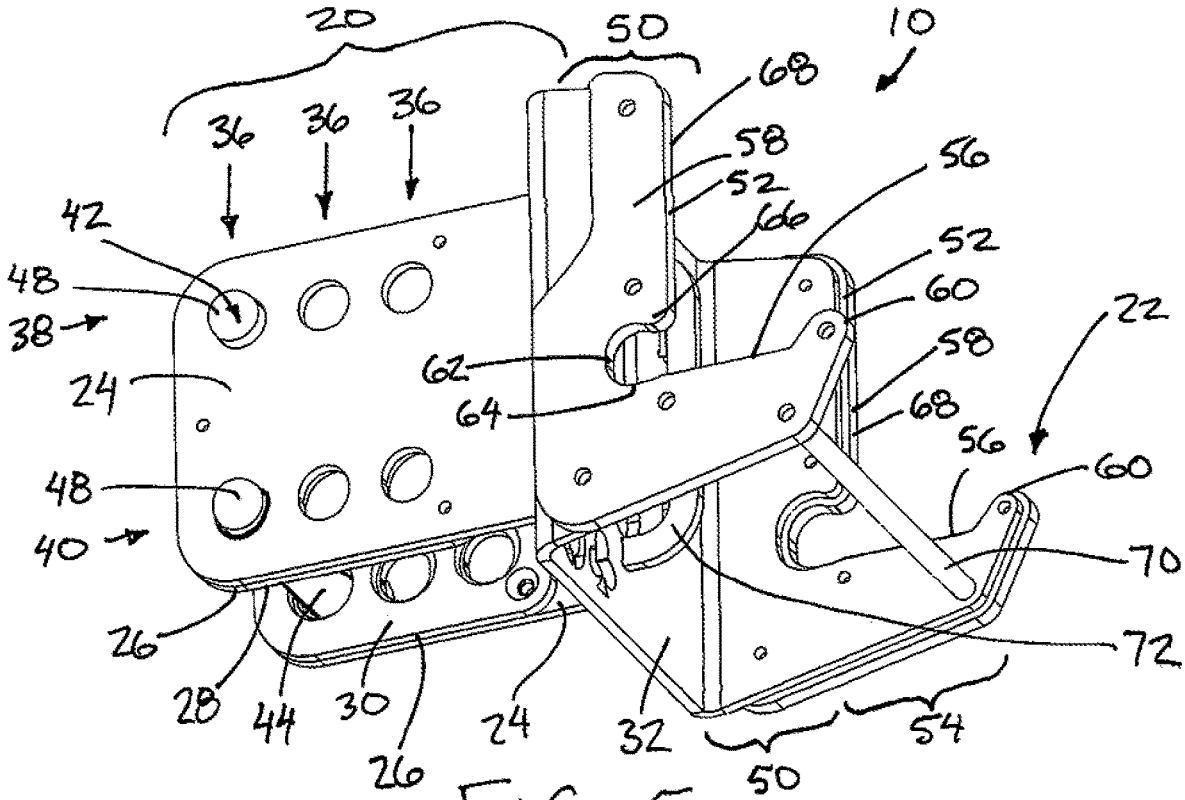
FIG. 5 is a perspective view of a bottom side of the apparatus according to the first embodiment of FIG. 1.

Referring to the accompanying figures there is illustrated a weight bar holding apparatus generally indicated by reference numeral 10.

The apparatus 10 is particularly suited for mounting as an attachment onto a singular vertical post 12 of exercise equipment, for example a weightlifting power rack of the type having, one, two, four or more posts joined by cross members to form a rigid frame. Each post 12 of the rack is a tubular member having four flat sides arranged to define a square cross sectional shape along the length of the post. Numerous mounting apertures extend transversely through the post at vertically spaced positions along the post at different respective elevations along the post. More particularly, a column of first apertures 14 extend through the post between a first pair of diametrically opposed sides of the post, and a column of second apertures 16 extend through the post perpendicularly to the first apertures between a second pair of diametrically opposed sides of the post. Each aperture 14 and 16 is defined by a first opening in the first side of the post and a second opening in the opposing second side of the post in alignment with one another along a common horizontal axis extending through the post.

The apparatus 10 serves to support a weight bar 18 of the type having an elongated shaft suitably sized and configured for being gripped by both hands of a user with their hands spaced apart at a typical shoulder-width spacing. Suitable collars (not shown) are mounted at opposing ends of the shaft for securing weighted discs on both opposing ends of the weight bar. The apparatus 10 can be mounted on a singular post 12 of the weightlifting rack while providing suitable supporting surfaces to support a two-handed weight bar in a stable manner thereon.

Although various embodiments are shown in the accompanying figures, the features of the first embodiment shown in FIGS. 1 to 5 will first be described.

The apparatus 10 generally comprises a mounting bracket 20 which mounts onto the post 12 and at least one hook 22 extending longitudinally forward from the bracket to support the weight bar 18 thereon.

The mounting bracket 20 includes two side plates 24 formed of rigid metal which are oriented vertically and spaced apart from one another in a lateral direction perpendicularly to the longitudinal direction of the protruding hooks 22. Each side plate 24 supports a plastic liner 26 thereon along an inner side surface of the side plate 24. The side plates with the plastic liners thereon collectively define a first mounting surface 28 and a second mounting surface 30 of the mounting bracket which are parallel and spaced apart from one another by a prescribed distance corresponding approximately to the width of the post 12 such that the mounting surfaces 28 and 30 are configured for abutting snugly against opposing sides of the post 12 when the mounting bracket is supported on the post. In the first embodiment, the plastic liners 26 are fastened to the side plates 24 using a set of three screws on each plate.

The side plates 24 extend longitudinally forward to respective forward ends which are joined to one another by a first cross member 32 extending in the lateral direction between the side plates. The first cross member 32 is a rigid metal plate oriented perpendicularly to the longitudinal direction of the hooks and the side plates while spanning a full height of the side plates. The cross member 32 is wider in the lateral direction than the fixed spacing of the side plates 24 such that the first cross member 32 protrudes laterally outwardly beyond both side plates 24 at laterally opposing ends thereof. The first cross member 32 supports the hooks 22 of the apparatus to extend longitudinally forward from the plate.

A second cross member 34 is provided in the form of an elongated bar extending in the lateral direction parallel to the first cross member 32 at a location spaced rearward from the first cross member. The second cross member 34 provides further stability to maintain the side plates 24 at a fixed and immovable spacing relative to one another. The second cross member 34 is spaced forwardly of the pin apertures in the side plates 24 that are described in further detail below.

The mounting bracket 20 defines a plurality of designated mounting locations 36 formed thereon at longitudinally spaced apart positions on the side plates 24. Each designated mounting location 36 is used with mounting pins described in further detail below to support the bracket at a selected longitudinal position relative to the post 12 which corresponds to a prescribed distance of the hooks 22 spaced forwardly from the post 12. Each designated mounting location 36 thus corresponds to a different position of the hooks relative to the post. Each designated mounting location comprises a pair of pin apertures including an upper pin aperture 38 and a lower pin aperture 40. More particularly, the upper pin aperture corresponds to two holes formed in the two side plates 24 in alignment with one another along a common first lateral axis extending fully through the mounting bracket. Likewise, the lower pin aperture corresponds to two holes formed in the two side plates 24 in alignment with one another along a common second lateral axis extending fully through the mounting bracket below the first lateral axis. The first and second lateral axes of each designated mounting location are aligned with one another in a common plane associated with the mounting location such that the plane lies perpendicular to the longitudinal direction of the hooks. The upper pin apertures 38 and the lower pin apertures 40 also communicate through the plastic liner plates 26 and are all the same size and configuration as one another, while being vertically spaced apart from one another by a distance corresponding to a spacing of corresponding ones of the first apertures 14 extending through the post 12.

The mounting pins include an upper mounting pin 42 and a lower mounting pin 44 that are inserted laterally through the upper pin aperture 38 and the lower pin aperture 40 of the selected designated mounting location corresponding to a selected longitudinal position of the hooks relative to the post. Each of the mounting pins comprises a rigid metal shaft sized to closely fit within the pin apertures while having a length that is greater than the lateral distance between outer sides of the two side plates 24. A head 46 is mounted at one end of each mounting pin while the opposing penetrating end 48 of the shaft opposite from the head 46 is tapered for ease of insertion into the pin apertures. The outer diameter may be sized to be substantially identical to the diameter of the pin apertures extending through the plastic liner 26 so that the mounting pin may be friction fit into the pin apertures.

The apparatus 10 according to the illustrated embodiment includes two hooks 22 mounted at laterally opposing ends of the first cross member 32 such that the hooks are spaced apart from one another in a lateral direction by a prescribed distance that is more than twice the corresponding dimension of the post 12. Each hook 22 is a rigid plate integrally formed as a continuous and seamless body with the first cross member 32. Furthermore, each hook includes a rear section 50 spanning the full height of the first cross member to protrude forwardly to a vertical front edge 52 spanning a majority of a height of the hook.

Each hook also includes a forward section 54 protruding forward from the bottom end of the rear section 50 so as to be recessed in height relative to the rear section. The forward section 54 has a top edge which extends horizontally forward in the longitudinal direction to define an upper hook surface 56 on the top side of the hook which lies parallel and in a common horizontal plane with the hook surface 56 of the other hook. The upper hook surface 56 of each hook is arranged to support a respective portion of the weight bar engaged thereon in use.

Each hook further includes an outer liner 58 in the form of a rigid plastic sheet fastened externally on the outer side of the rigid metal plate forming the main body of the hook 22. The outer liner 58 is shaped to follow the forward contour of the hook 22 while protruding slightly forwardly and above each corresponding edge of the rigid metal plate of the hook 22 such that the edges of the liner 58 effectively define all of the working edges of the overall hook 22 including the upper hook surface 56 which supports the weight bar engaged thereon and other working surfaces of the hooks 22 as described in the following. This is done to prevent metal to metal contact on the barbell and therefore prevent barbell wear over time.

Each hook has a raised protrusion 60 formed at the distal or forward end of the hook to protrude upwardly from the upper hook surface 56 of the hook. Both the rigid metal plate and the outer liner 58 form the contour of the raised protrusion 60. The protrusion 60 prevents a weight bar engaged upon the upper hook surface from rolling forwardly off the forward end of the hook.

Each hook also includes a slot 62 formed in the rear section 50 immediately above the upper hook surface. The slot forms a generally concave socket which is slightly larger in diameter than the diameter of the weight bar such that the weight bar can be readily inserted into and removed from the slot 62. The bottom of the slot 62 is substantially aligned with the upper hook surface 56 while being slightly lower in elevation, for example approximately 1 mm below the upper hook surface so as to define a recessed surface 64 at the inner end of the hook surface which is arranged to receive the weight bar engaged thereon. Due to the lower elevation of the recessed surface 64, a weight bar engaged upon the upper hook surfaces 56 can be easily rolled rearwardly and into the slots by rolling down into the recessed surfaces 64; however, once the weight bar is engaged upon the recessed surfaces 64 of the hooks, gravity resists the weight bar rolling back upwardly and forwardly to the upper hook surface 56 so as to provide a slight resistance retaining the weight bar within the slots. The recessed surface may be slightly concave to position the weight bar centrally thereon in the longitudinal direction.

The upper boundary of the slot 62 is defined by an undercut portion of the rear section 50 of the hook above the slot which defines a stop member 66 immediately above the recessed surface 64. The stop member is spaced above the recessed surface 64 by a distance which is slightly greater than the diameter of the weight bar. The stop member 66 is defined as a bottom surface which is generally concave in shape and which is formed as part of the rear section 50 of the hook that protrudes forwardly above the upper hook surface 56. The concave profile of the stop member 66 above the slot results in a forward portion of the upper boundary edge of the slot 62 being sloped downwardly and forwardly away from the mounting bracket towards the open mouth at the front of the slot. In this instance, when a weight bar is supported to span across between the two hooks while being received within the slot 62 of the two hooks, overloading one end of the bar so as to produce a tipping of the bar about one of the hooks acting as a lower fulcrum below the bar and a lifting at one end of the bar, the lifting bar will engage the stop member 66 and the upward and rearward slope of the upper boundary of the slot guides the weight bar rearwardly to remain engaged within the slot. The slot thus continues to prevent any further tipping of the weight bar beyond an initial slight deflection so as to provide an anti-tip function to the apparatus 10.

A remainder of the rear section 50 of each hook is arranged such that the vertical front edge 52 extends vertically upward from the forward end of the stop member 66 above the slot 62 to define a guide surface 68 above the upper hook surface 56 that guides a weight bar being lowered onto the upper hook surfaces of the hooks.

As described above, the outer liner 58 of plastic material protrudes above and forwardly of each of the working edges of the hooks. The plastic liner is of a suitably thick and rigid material to be weight bearing when fastened at multiple locations to the corresponding rigid plates of the hook so as to be fixed and immovable relative to the hooks. The protruding liner defines the contours of the guide surfaces 68, the stop members 66, the slot 62, the recessed surface 64 of the slot, the upper hook surface 56, and the raised protrusion 60 as described above.

The two hooks 22 are further supported relative to one another by a hook cross member 70 in the form of an elongate rigid bar connected in the lateral direction between the rigid plates of the hooks 22 respectively. The cross member is joined to the hooks 22 at a location closer to the distal forward ends of the hooks than the mounting bracket at the rear of the hooks. The cross member 70 is also spaced below the elevation of the upper hook surface, while being aligned in the longitudinal direction of the hooks approximately below the raised protrusions 60 of the hooks to maximize stability between the distal ends of the hooks relative to one another.

The apparatus 10 further includes a handle member 72 in the form of an upright rigid bar which is shaped and configured for being comfortably gripped in one hand of a user. The upright bar forming the handle member 72 is mounted at opposing top and bottom ends on the first cross member 32 so that the upright bar is spaced slightly forward of the cross member to receive fingers of the user between the upright bar and the plate forming the first cross member 32. The handle member 72 is configured to protrude in the longitudinal direction forwardly and away from the mounting bracket while being laterally centred between the side plates 24 and laterally centred between the hooks 22 so as to be spaced laterally inwardly from both hooks.

The handle member 72 protrudes forwardly from the plate forming the first cross member 32 by a distance which is less than the protruding distance of the vertical guide surfaces 52 of the hook members from the first cross member 32. The handle member 72 also protrudes forwardly from the plate forming the first cross member 32 by a distance which is less than the distance of the inner terminal ends of the slots 62 from the mounting bracket. In this manner there is no interference by the handle member 72 when the weight bar being dropped downwardly along the vertical guide surfaces 68 towards the upper hook surface. Also, there is no interference by the handle member 72 when the weight bar is inserted rearwardly into the slots 62 for retaining the weight bar in an anti-tip manner on the recessed surfaces 64 at the inner ends of the upper hook surfaces.

Use of the apparatus typically involves the user initially mounting the apparatus onto the post 12 by gripping the handle member 72 in one hand of the user so that the other hand is free to insert the upper and lower mounting pins 42 and 44 into the upper pin aperture 38 and the lower pin aperture 40 of a selected designated mounting location corresponding to a selected distance of the hooks from the post. The user then grips the weight bar with two hands at approximate shoulder width apart which is wider than the width between the two hooks 22 of the apparatus 10. The user places a central portion of the weight bar between their hands onto the two hooks and the bar is then displaced rearwardly into the slot 62 to safely retain the bar on the hooks of the apparatus 10 in an anti-tip configuration. Any imbalance created by loading at one end of the weight bar so as to produce lifting of the opposing end of the weight bar will result in the weight bar engaging the corresponding surfaces of the stop member 66 at the upper boundary of the corresponding slot which urges the weight bar to remain engaged within the slot 62. Once the weight bar has been properly loaded, the user displaces the weight bar forwardly onto the upper hook surfaces forwardly of the slots 62 so that the weight bar can be lifted vertically upward and off of the hooks 22 to perform exercise. When a lifting exercise is complete, the weight bar can be lowered back onto the upper hook surfaces by using the vertical guide surfaces 68 against which the weight bar can be engaged for vertical sliding downward toward the slots.

The vertical height of the guide surfaces 68 of the hooks is greater than the horizontal length of the upper hook surfaces 56 between the slot 62 and the raised protrusions 60 to ensure that the hooks 22 have a high degree of strength while being supported adequately at a close distance from the mounting bracket.

Depending on the exercise to be performed by the user, the user can select the horizontal distance of the hooks 22 from the post 12 once the weight bar has been removed from the hooks 22. In this instance, the user grips the handle member 72 in one hand and uses the other hand to remove the upper and lower pins 42 and 44. Once the pins have been removed, the user aligns the pin apertures of a different mounting location with corresponding mounting apertures of the post 12 to select a different distance of the hooks 22 from the post. At the same time, the apparatus can be aligned with different mounting apertures along the height of the post to vary the height of the apparatus 10. Replacing both pins 42 and 44 within the corresponding apertures acts to again support the apparatus in a stable manner relative to the post 12 so that a weight bar can again be supported onto the corresponding surfaces of the hooks 22 respectively.

Figure 6:
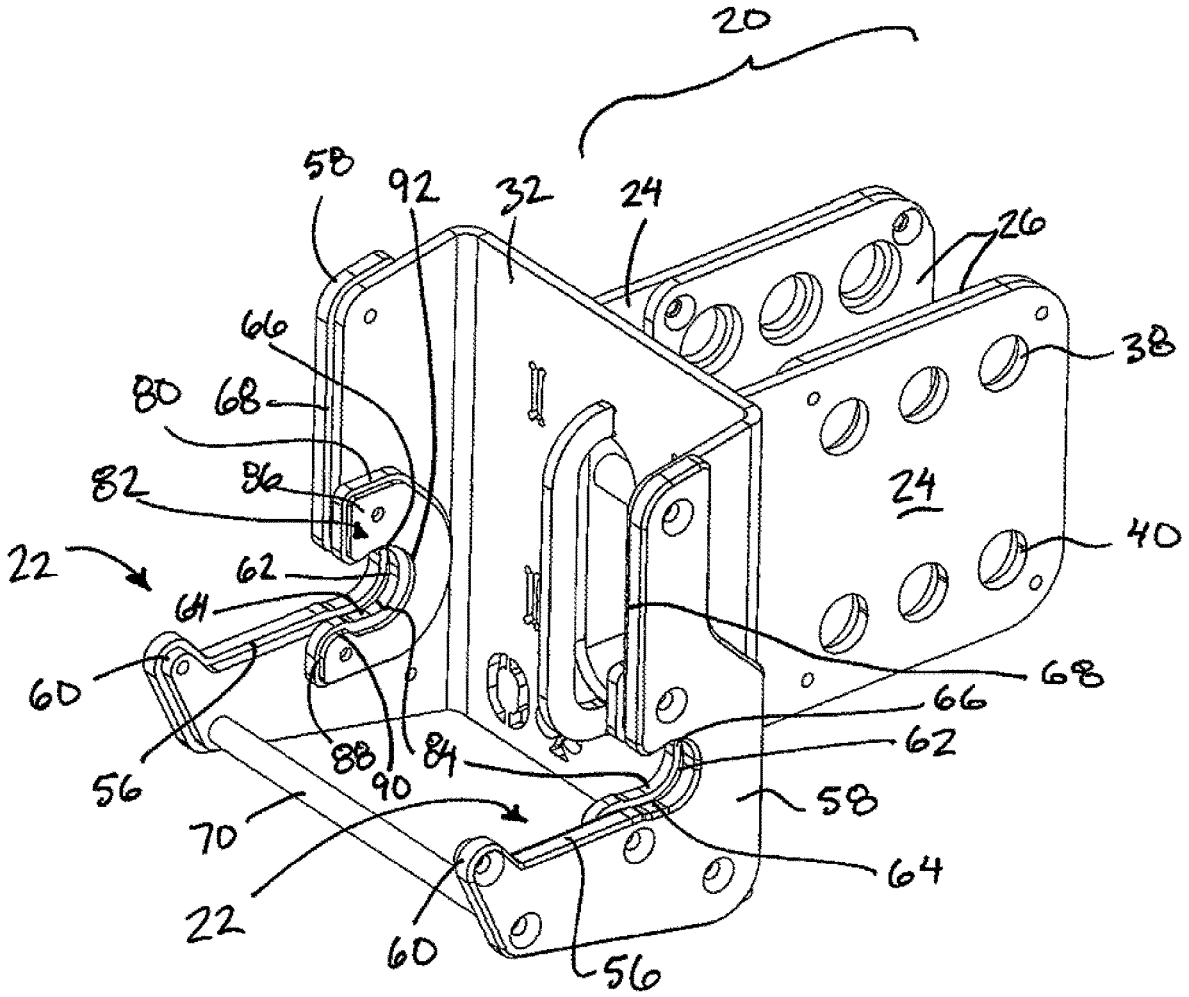
FIG. 6 is a perspective view of the apparatus according to a second embodiment, shown separated from the weight lifting rack.

Turning now to FIG. 6, according to the second embodiment, the apparatus 10 is identical to the first embodiment with the exception of (i) the fastening of the plastic liners 26 on the side plates 24, and (ii) the addition of inner liners 80 formed of plastic secured by fastening plates 82 formed of metal onto the inner surfaces of the hooks 22 respectively. In this instance, each plastic liner 26 is fastened to the inner side of the respective side plate 24 using a set of four screws arranged in a rectangular pattern in proximity to the four corners of the liner 26.

Each inner liner 80 is a sheet of rigid plastic material, for example ultra high molecular weight polyethylene similar to the other plastic liners of the apparatus. The inner liner 80 is smaller than the outer liner 80 and has a supporting inner edge 84 that follows a C-shaped pattern about the slot 62 at the inner end of the hook surface, including the stop member 66 forming the upper boundary of the slot 62 and the recessed surface 64 forming the lower boundary of the slot 62. An upper portion 86 of each inner liner 80 terminates at the vertical front edge 52 of the hook. A lower portion 88 of each inner liner 80 terminates at a forward lip 90 that protrudes upwardly from the recessed surface 64 to be at a similar elevation as the upper hook surface 56. The forward lip 90 at the forward boundary of the lower portion 88 is spaced rearwardly of the raised protrusion 60 at the forward end of the hook 22.

The inner edge 84 of each inner liner 80 thus matches the relevant contours of the outer liners 58, while remaining in protruding relation to the corresponding forward edges of the side plates 24 to prevent direct contact between the barbell and the metal side plates 24. Due to the matching profiles, the inner and outer liners 80 and 58 provide a balanced support of a barbell on the side plates 24 in use.

The fastening plates 82 provide structural support to retain the inner liners 80 fastened to the inner sides of the side plates 24 respectively. Each fastening plate is similar in shape to the respective inner liner 80, while having a forward boundary edge 92 that is recessed relative to the corresponding inner edge 84 of the inner liner about the full contour of the forward boundary edge to prevent direct contact of the fastening plates 82 with barbells supported on the hooks. The fastening plates 82 have internally threaded fastener bores formed therein so that threaded fasteners inserted through the outer liners 58, the sides plates 24 and the inner liners 80 can be threaded into the bores in the fastening plates 82 to clamp all of the layers against one another.

Since various modifications can be made in the invention as herein above described, and many apparently widely different embodiments of same made, it is intended that all matter contained in the accompanying specification shall be interpreted as illustrative only and not in a limiting sense.

The invention claimed is:

1. A weight bar holding apparatus in combination with exercise equipment for supporting a weight bar on the exercise equipment, in which the exercise equipment is a weightlifting rack having upright posts joined by crossbars to define a rigid frame and in which the upright posts have transverse apertures formed therein at different respective elevations along the upright posts, the weight bar holding apparatus comprising:

a mounting bracket having first and second mounting surfaces that are parallel and spaced apart from one another, the first and second mounting surfaces being abutted against opposing sides of a single post among the upright posts of the rigid frame;

at least one mounting pin mounted on the mounting bracket to extend through a respective one of the transverse apertures in the single post to support mounting bracket at the respective elevation along the single post in a mounted position of the weight bar holding apparatus; and two hooks protruding in a longitudinal direction from the mounting bracket, each hook including an upper hook surface arranged to receive a portion of the weight bar thereon in which the upper hook surfaces lie in a common horizontal plane in the mounted position of the weight bar holding apparatus;

wherein the two hooks are spaced apart from one another transversely to the longitudinal direction by a prescribed space that is more than a corresponding width of the single post.

2. The weight bar holding apparatus according to claim 1, wherein:

said at least one mounting pin includes an upper mounting pin and a lower mounting pin;

the mounting bracket includes a plurality of designated mounting locations formed thereon at spaced apart positions in the longitudinal direction corresponding to respective selected distances of the two hooks from the single post; and each designated mounting location includes an upper pin aperture and a lower pin aperture arranged to receive the upper mounting pin and the lower mounting pin respectively therein when the mounting pins are received through the transverse apertures of the single post at the respective selected distance of the hooks from the single post.

3. The weight bar holding apparatus according to claim 2, wherein the mounting bracket comprises: a first side plate locating the first mounting surface thereon, a second side plate locating the second mounting surface thereon, a first cross member joined between the first and second side plates, and a second cross member joined between the first and second side plates at a location spaced in the longitudinal direction from the first cross member, the pin apertures extending through the first and second side plates parallel to the first and second cross members.

4. The weight bar holding apparatus according to claim 3, wherein the first cross member comprises a plate joined between the first and second side plates so as to lie perpendicularly to the longitudinal direction, and wherein the second cross member comprises an elongated crossbar.

5. The weight bar holding apparatus according to claim 1, further comprising a cross member connected between the two hooks at a location spaced longitudinally from the mounting bracket.

6. The weight bar holding apparatus according to claim 5, wherein the cross member is spaced below the upper hook surfaces.

7. The weight bar holding apparatus according to claim 5, wherein the two hooks each include a raised protrusion extending above the upper hook surface at a location spaced from the mounting bracket, and wherein the cross member is nearer to the raised protrusion than the mounting bracket.

8. The weight bar holding apparatus according to claim 1, wherein each hook further comprises a guide surface extending vertically above the upper hook surface adjacent to the mounting bracket.

9. The weight bar holding apparatus according to claim 8, wherein the guide surface is greater in height than a length of the upper hook surface.

10. The weight bar holding apparatus according to claim 1, wherein each hook further includes a stop member spaced above the upper hook surface having a bottom surface protruding longitudinally from the mounting bracket so as to be arranged to receive the weight bar on the hook surface beneath the stop member and prevent upward lifting of the weight bar by engagement of the weight bar with the bottom surface of the stop member, and wherein the upper hook surface protrudes longitudinally from the mounting bracket farther than the stop member.

11. The weight bar holding apparatus according to claim 10, wherein each hook further comprises a recessed surface formed at an inner end of the upper hook surface nearest to the mounting bracket, the recessed surface being recessed in elevation below the upper hook surface, and the recessed surface being aligned in the longitudinal direction with the stop member above the recessed surface.

12. The weight bar holding apparatus according to claim 10, wherein the bottom surface of the stop member is sloped downwardly and away from the mounting bracket towards an outer end of the stop member farthest from the mounting bracket.

13. The weight bar holding apparatus according to claim 10, wherein each hook further comprises a guide surface extending vertically upward from the stop member above the upper hook surface in which the upper hook surface protrudes longitudinally outward beyond the guide surface.

14. The weight bar holding apparatus according claim 1, further comprising a handle member mounted on the mounting bracket so as to protrude from the mounting bracket in the longitudinal direction with the two hooks, the handle member being spaced laterally inwardly from each of the two hooks and the handle member being configured to be gripped by a hand of a user.

15. The weight bar holding apparatus according to claim 14, wherein each hook further comprises a guide surface extending vertically upward from the stop member above the upper hook surface in which the guide surfaces are spaced longitudinally outward from the mounting bracket farther than an outermost portion of the handle member.

16. A weight bar holding apparatus for supporting a weight bar on an upright post of exercise equipment, the upright post having transverse apertures formed therein at different respective elevations along the upright post, the weight bar holding apparatus comprising:

a mounting bracket having first and second mounting surfaces that are parallel and spaced apart from one another so as to be arranged for abutment against opposing sides of the upright post;

at least one mounting pin arranged to be mounted on the mounting bracket to extend through a respective one of the transverse apertures in the upright post to support mounting bracket at the respective elevation along the upright post in a mounted position of the weight bar holding apparatus; and at least one hook protruding in a longitudinal direction from the mounting bracket in which the hook includes (i) an upper hook surface arranged to receive a portion of the weight bar thereon and (ii) a stop member spaced above the upper hook surface and having a bottom surface protruding longitudinally from the mounting bracket so as to be arranged to receive the weight bar on the hook surface below the stop member and prevent upward lifting of the weight bar by engagement of the weight bar with the bottom surface of the stop member, wherein in the upper hook surface protrudes longitudinally from the mounting bracket further than the stop member.

17. The weight bar holding apparatus according to claim 16, wherein said at least one hook further comprises a recessed surface formed at an inner end of the upper hook surface nearest to the mounting bracket, the recessed surface being recessed in elevation below the upper hook surface, and the recessed surface being aligned in the longitudinal direction with the stop member above the recessed surface.

18. The weight bar holding apparatus according to claim 16, wherein said at least one hook is further arranged such that the bottom surface is sloped downwardly and away from the mounting bracket towards an outer end of the stop member farthest from the mounting bracket.

19. A weight bar holding apparatus for supporting a weight bar on an upright post of exercise equipment, the upright post having transverse apertures formed therein at different respective elevations along the upright post, the weight bar holding apparatus comprising:

a mounting bracket having first and second mounting surfaces that are parallel and spaced apart from one another so as to be arranged for abutment against opposing sides of the upright post; and at least one hook protruding in a longitudinal direction from the mounting bracket and the upright post, in which the hook includes an upper hook surface arranged to receive a portion of the weight bar thereon; and an upper mounting pin and a lower mounting pin arranged to be mounted on the mounting bracket to extend through a respective pair of the transverse apertures in the upright post to support mounting bracket on the upright post;

wherein the mounting bracket includes a plurality of designated mounting locations formed thereon at spaced apart positions in said longitudinal direction that the at least one hook protrudes from the mounting bracket, such that the designated mounting locations correspond to respective selected distances of the at least one hook from the upright post measured in said longitudinal direction in which the selected distances of the designated mounting locations are different from one another; and wherein each designated mounting location includes an upper pin aperture and a lower pin aperture arranged to receive the upper mounting pin and the lower mounting pin respectively therein when the mounting pins are received through the transverse apertures of the upright post at the respective selected distance of the at least one hook from the upright post.

20. The weight bar holding apparatus according to claim 19, wherein the mounting bracket comprises: a first side plate locating the first mounting surface thereon, a second side plate locating the second mounting surface thereon, a first cross member joined between the first and second side plates, and a second cross member joined between the first and second side plates at a location spaced in the longitudinal direction from the first cross member, the pin apertures extending through the first and second side plates parallel to the first and second cross members.

* * * * *